US005096619A

United States Patent [19]

Slack

[11] Patent Number: 5,096,619

[45] Date of Patent: Mar. 17, 1992

[54] THICK FILM LOW-END RESISTOR COMPOSITION

[75] Inventor: Lyle H. Slack, Wilmington, Del.

[73] Assignee: E. I. Du Pont de Nemours and Company, Wilmington, Del.

[21] Appl. No.: 526,956

[22] Filed: May 23, 1990

Related U.S. Application Data

[63] Continuation of Ser. No. 327,716, Mar. 23, 1989, abandoned.

[51] Int. Cl.[5] ..... H01B 1/06

[52] U.S. Cl. ..... 252/514; 252/518; 524/439; 524/434

[58] Field of Search ..... 252/514, 518; 106/1.18, 106/1.19, 1.21; 524/439, 434, 435, 440

[56] References Cited

U.S. PATENT DOCUMENTS

| | | | |
|---|---|---|---|
| 4,160,227 | 7/1979 | Ikegami et al. | 338/22 R |
| 4,347,166 | 8/1982 | Tosaki et al. | 252/519 |
| 4,414,143 | 11/1983 | Felten | 252/514 |
| 4,418,009 | 11/1983 | Holmes et al. | 252/514 |
| 4,476,039 | 10/1984 | Hormadaly | 252/518 |
| 4,503,090 | 3/1985 | Brown et al. | 252/518 |
| 4,517,545 | 5/1985 | Merz | 252/514 |
| 4,552,691 | 11/1985 | Shoji et al. | 252/514 |
| 4,561,996 | 12/1985 | Holmes et al. | 252/514 |
| 4,574,055 | 3/1986 | Asada et al. | 252/514 |
| 4,587,040 | 5/1986 | Tosaki et al. | 252/519 |

*Primary Examiner*—Josephine Barr

[57] ABSTRACT

A thick film low-end resistor composition comprising an admixture of finely divided particles of (a) silver, palladium, an alloy of palladium and silver, or mixtures thereof; (b) an admixture of (1) glass having a softening point of 350° to 500° C., which when molten is wetting with respect to the other solids in the composition, and (2) glass having a softening point of 550° to 650° C.; and (c) 5-20% by volume, basis total solids, of sub-micron particles of $RuO_2$, all of (a) through (c) being dispersed in (d) an organic medium.

9 Claims, No Drawings

THICK FILM LOW-END RESISTOR COMPOSITION

This application is a continuation of application Ser. No. 07/327,716 filed Mar. 23, 1989 now abandoned.

FIELD OF INVENTION

The invention relates to improved thick film low-end resistor compositions having improved laser trim stability which are especially suitable for the manufacture of chip resistors.

BACKGROUND OF THE INVENTION

Chip resistors are typically screen printed as thick film pastes on a large, square alumina substrate with as many as a thousand chip resistors on a single such substrate. The printed resistors are then fired to remove all of the organic medium from the printed pattern and to densify the solids. A first encapsulant glass layer is printed over the resistors and fired. The resistor values at this point have a distribution of 3-5%. The once encapsulated resistors are trimmed with a laser beam directly through the encapsulant, and the printed resistor layer, and into the alumina substrate. The laser trimming increases resistance values about 50%, but reduces the distribution of resistance values to about 0.1%

After laser trimming through the first encapsulant layer and the resistor, a second glass encapsulant is printed over the trimmed resistor and fired at 600° C. After firing the second encapsulant layer, the large substrate is broken into strips and a conductive edge termination is applied by dipping the edge of the strips into a conductive paste. The thusly terminated strips are then fired. After firing the edge terminations, the strips are broken into individual chips and the chip terminations are nickel and solder-plated. The finished chip resistors are about the size of a large grain of sand. They are usually soldered to a printed wiring board for use.

Chip resistors such as those described above are frequently made in a wide range of resistances from 1 to 1,000,000 ohms, and to be effective, they must have a resistance shift upon encapsulation and trimming of no more than 0.5%. Resistance stabilities such as this, however, are very difficult to achieve with low-end resistors, i.e., those having resistance values of only 1-100 ohms per square.

Low-end resistance resistors of the current state-of-the-art, such as those based on $RuO_2$ alone, tend to have resistance shifts exceeding 0.5% in 1000 hours after laser trimming, whereas higher resistance resistors are much more stable. In addition, the state-of-the-art low resistance resistors are traditionally difficult to manufacture to a resistance of ±10% and a temperature coefficient of resistance (TCR) of ±100 ppm/° C. because a dense, consistent, insensitive microstructure is difficult to achieve. The relatively low volume fraction of glass binder phase in such compositions makes it difficult to achieve this desired dense, consistent microstructure.

SUMMARY OF THE INVENTION

The present invention solves these problems by using ingredients that provide a relatively dense, low-porosity and therefore stable microstructure. The low softening point glasses and alloying action of the Pd and Ag provide a microstructural activity during resistor firing which gives a dense microstructure for stable resistor performance and consistent lot-to-lot performance. Additional benefits include the low resistance resistors' ability to carry power, which varies from 1.5 to 2 times that of $RuO_2$-based resistors. Thus, the present invention overcomes the many problems of the prior art.

In its primary aspect, the invention is directed to a thick film low-end resistor composition comprising an admixture of finely divided particles of:

(a) an alloy of palladium and silver, an admixture of oxides of palladium and silver, or mixtures thereof, the proportions by weight of palladium and silver being respectively from 32 to 58% and from 68 to 42%, (b) an admixture of (1) 0.2 to 5.0% weight, basis total solids, of glass having a softening point of 350° to 500° C., which when molten is wetting with respect to the other solids in the composition, and (2) glass having a softening point of 550° to 650° C.; and (c) 5-20% by volume, basis total solids, of sub-micron particles of $RuO_2$, all of (a) through (c) being dispersed in (d) an organic medium.

In a secondary aspect, the invention is directed to a method for making low-end resistors comprising the sequential steps of:

(a) applying a patterned layer of the above-described thick film composition to an inert substrate; and (b) firing the layer at a peak temperature of 800°-900° C. to effect volatilization of the organic medium therefrom and densification of the solids.

DETAILED DESCRIPTION OF THE INVENTION

A. Conductive Metal

The conductive phase of the compositions of the invention is an alloy of palladium and silver or it can be a mixture of palladium and silver metal particles. Mixtures of both can be used as well. The preferred ratio by weight of palladium to silver is 40:60 because of the sintering and alloying characteristics of that particular ratio. However, palladium/silver ratios of as low as 32:68 and as high as 58:48 can also be used.

The particle size of the metal(s) is not particularly important so long as it is suitable for the method of application. However, it is preferred that the metal particles be within the range of 0.5-5 microns.

B. Inorganic Binder

The inorganic binder component of the invention is comprised of two glasses. One of the glasses must be low melting and be capable of wetting the surface of the other solids in the composition. The low melting glass must have a softening point (Dilatometer) of 350°-500° C. and must be capable of wetting the surface of the other solids in the composition, i.e., the second glass, the conductive metal and the $RuO_2$. The wetting characteristics of the glass are readily determined by measuring the contact angle of the molten glass on a surface of each of the other solids, at the expected firing temperature (800°-900° C.). Suitable wettability for the purposes of the invention is established if the contact angle of the low melting glass on the other solids is 30° or less and preferably no more than 10°.

It is necessary that the softening point of the lower melting glass not exceed about 500° C. lest the glass flow during firing be insufficient to obtain proper melting of the other solid particles. On the other hand, if the softening point of the glass is below 350° C., glass flow during firing may become excessive and result in maldistribution of the glass throughout the fired resistor. It is preferred that the softening point of the lower melting glass be in the range of 375°–425° C. for optimum performance.

The second essential component of the inorganic binder is the higher melting glass which has a softening point (Dilatometer) of 550°–650° C. and preferably 575°–600° C. It is preferred that the softening point of the glass not be lower than about 550° C. for the reason that the temperature coefficient of expansion (TCE) of such glasses tends to be excessive in comparison with conventional substrate materials. On the other hand, if the softening point significantly exceeds 650° C., the microstructure of the fired resistor is less uniform and the resistor becomes less durable.

Provided that the physical properties of the two glasses are appropriate, the composition of the glasses is not by itself critical except as it relates to the viscosity and wetting properties of the glass when the composition is fired. Thus a wide variety of oxide glasses containing conventional glass-forming and glass-modifying components can be used, e.g., alumino borosilicates, lead silicates such as lead borosilicate and lead silicate itself and bismuth silicates and the like. It is, however, necessary that the low softening point glass be noncrystallizing (amorphous) at firing temperatures in order to get a proper amount of glass flow during the firing process.

The total amount of inorganic binder in the composition of the invention is in part a function of the desired resistor properties. For example, a 1 ohm/square resistor will require on the order of 45% vol. inorganic binder, a 10 ohm/square resistor will require about 65% vol. glass binder, and a 100 ohm/square resistor will contain about 75% vol. glass binder. Thus the amount of binder may vary by volume from as low as, say, 40% to as high as 80%, but will usually fall within the range of 50 to 65%.

The relative amount of low softening point glass in the inorganic binder is a function of the total solids in the composition and the wettability of the lower melting glass on the other solids. In particular, it has been found that at least 0.2% wt. and preferably at least 0.5% wt. low melting glass is needed to get adequate wetting of all the solids. However, if more than about 5% wt. low melting glass is used, the composition tends to incur blistering upon firing.

The particle size of the inorganic binder is not particularly critical. However, the glass particles should be in the range of 0.1–10 microns (preferably 0.5–5 microns) and have an average particle size of 2–3 microns. Glass fines below 0.1 micron have so much surface area that too much organic medium is needed to obtain the proper rheology of the paste for printing. On the other hand, if the particles are larger than 10 microns, they interfere with screen printing.

C. Ruthenium Dioxide

A minor amount of ruthenium dioxide ($RuO_2$) is required in the composition of the invention in order to lower the TCR of the composition. The amount of RuO2 needed is related to the total volume of the composition solids. In particular, at least 5% vol. $RuO_2$ is needed, but up to 20% vol. RuO2 may be used in some instances. Below 5% vol. $RuO_2$ it is diffcult to make resistors reproducibly and above about 20% vol. the total amount of conductive phase becomes excessive and correspondingly the amount of glass is insufficient to give a good microstructure. However, the particle size of the $RuO_2$ should always be less than 1 micron in order to give adequate TCR properties.

The $RuO_2$ can be added to the composition in either of two forms. It can be added as discrete $RuO_2$ particles or it can be added in the form of $RuO_2$ particles sintered onto the surface of glass particles. It is preferred to introduce the $RuO_2$ sintered onto the surface of glass particles in order to obtain more even particle distribution, better wetting and more even coating of the $RuO_2$ particles and also to reduce catalytic action by the particles when they are dispersed in the organic medium. In the latter instance, the particles are prepared by admixing the $RuO_2$ particles with glass particles, heating the admixture to above the softening point of the glass so that the glass sinters but does not melt and flow, and then milling the sintered product.

It is preferred that the glass used for $RuO_2$ addition have an intermediate softening point range of 400°–650° C., which is intermediate to the softening point range of the primary glass components of the inorganic binder. The purpose of this is to obtain good wetting and coating of the $RuO_2$ without incurring too much dislocation of the glass during firing. It is also preferred that the intermediate glass contain a minor amount of one or more transition metal oxides such as $MnO_2$, $Co_2O_3$, $Fe_3O_4$, CuO, $Ni_2O_3$ and the like to facilitate further TCR control. About 1% wt. is required to be effective and as much as 20% wt. might be used in some instances. It is preferred, however, to use no more than 15% wt. transition metal oxide to avoid excessive moisture sensitivity.

D. Organic Medium

The inorganic particles are mixed with an organic liquid medium (vehicle) by mechanical mixing to form a pastelike composition having suitable consistency and rheology for screen printing. The paste is then printed as a "thick film" on dielectric or other substrates in the conventional manner.

The main purpose of the organic medium is to serve as a vehicle for dispersion of the finely divided solids of the composition in such form that it can readily be applied to a ceramic or other substrate. Thus, the organic medium must first of all be one in which the solids are dispersible with an adequate degree of stability. Secondly, the rheological properties of the organic medium must be such that they lend good application properties to the dispersion.

Most thick film compositions are applied to a substrate by means of screen printing. Therefore, they must have appropriate viscosity so that they can be passed through the screen readily. In addition, they should be thixotropic in order that they set up rapidly after being screened, thereby giving good resolution. While the rheological properties are of primary importance, the organic medium is preferably formulated also to give appropriate wettability of the solids and the substrate, good drying rate, dried film strength sufficient to withstand rough handling and good firing properties. Satisfactory appearance of the fired composition is also important.

In view of all these criteria, a wide variety of inert liquids can be used as organic medium. The organic medium for most thick film compositions is typically a solution of resin in a solvent and, frequently, a solvent solution containing both resin and thixotropic agent. The solvent usually boils within the range of 130°-350° C.

By far, the most frequently used resin for this purpose is ethyl cellulose. However, resins such as ethylhydroxyethyl cellulose, wood rosin, mixtures of ethyl cellulose and phenolic resins, polymethacrylates of lower alcohols and monobutyl ether of ethylene glycol monoacetate can also be used.

The most widely used solvents for thick film applications are terpenes such as alpha- or beta-terpineol or mixtures thereof with other solvents such as kerosene, dibutylphthalate, butyl carbitol, butyl carbitol acetate, hexylene glycol and high boiling alcohols and alcohol esters. Various combinations of these and other solvents are formulated to obtain the desired viscosity and volatility requirements for each application.

Among the thixotropic agents which are commonly used are hydrogenated castor oil and derivatives thereof and ethyl cellulose. It is, of course, not always necessary to incorporate a thixotropic agent since the solvent/resin properties coupled with the shear thinning inherent in any suspension may alone be suitable in this regard.

The ratio of organic medium to solids in the dispersions can vary considerably and depends upon the manner in which the dispersion is to be applied and the kind of organic medium used. Normally, to achieve good coverage, the dispersions will contain complementary by weight 60-90% solids and 40-10% organic medium. Such dispersions are usually of semifluid consistency and are referred to commonly as "pastes".

The viscosity of the pastes for screen printing is typically within the following ranges when measured on a Brookfield HBT Viscometer at low, moderate and high shear rates:

| Shear Rate ($sec^{-1}$) | Viscosity (Pa · S) |
|---|---|
| 0.2 | 100-5000 — |
| | 300-2000 Preferred |
| | 600-1500 Most Preferred |
| 4 | 40-400 — |
| | 100-250 Preferred |
| | 140-200 Most Preferred |
| 384* | 4-40 — |
| | 10-25 Preferred |
| | 12-18 Most Preferred |

*Measured on HBT Cone and Plate Model Brookfield Viscometer

The amount of vehicle utilized is determined by the final desired formulation viscosity.

TEST PROCEDURES

A. Sample Preparation

Samples to be tested for temperature coefficient of resistance (TCR) are prepared as follows:

A pattern of the resistor formulation to be tested is screen printed upon each of ten coded Alsimag 614 1×1" ceramic substrates and allowed to equilibrate at room temperature and then dried at 150° C. The mean thickness of each set of ten dried films before firing must be 22-28 microns as measured by a Brush Surfanalyzer. The dried and printed substrate is then fired for about 60 minutes using a cycle of heating at 35° C. per minute to 850° C., dwell at 850° C. for 9 to 10 minutes, and cooled at a rate of 30° C. per minute to ambient temperature.

B. Resistance Measurement and Calculations

Substrates prepared as described above are mounted on terminal posts within a controlled temperature chamber and electrically connected to a digital ohmmeter. The temperature in the chamber is adjusted to 25° C. and allowed to equilibrate, after which the resistance of each substrate is measured and recorded.

The temperature of the chamber is then raised to 125° C. and allowed to equilibrate, after which the resistance of the substrate is again measured and recorded.

The temperature of the chamber is then cooled to −55° C. and allowed to equilibrate and the cold resistance measured and recorded.

The hot and cold temperature coefficients of resistance (TCR) are calculated as follows:

$$\text{Hot } TCR = \frac{R_{125^\circ C.} - R_{25^\circ C.}}{R_{25^\circ C.}} \times (10{,}000) \text{ ppm/°C.}$$

$$\text{Cold } TCR = \frac{R_{-55^\circ C.} - R_{25^\circ C.}}{R_{25^\circ C.}} \times (-12{,}500) \text{ ppm/°C.}$$

The values of $R_{25^\circ C.}$ and Hot and Cold TCR are averaged and $R_{25^\circ C.}$ values are normalized to 25 microns dry printed thickness, and resistivity is reported as ohms per square at 25 microns dry print thickness. Normalization of the multiple test values is calculated with the following relationship:

$$\text{Normalized Resistance} = \frac{\text{Avg. Measured Resistance} \times \text{Avg. Dry Print Thickness, microns}}{\text{25 Microns}}$$

C. Laser Trim Stability

Laser trimming of thick film resistors is an important technique for the production of hybrid microelectronic circuits. [A discussion can be found in *Thick Film Hybrid Microcircuit Technology* by D. W. Hamer and J. V. Biggers (Wiley, 1972), p. 173 ff.] Its use can be understood by considering that the resistances of a particular resistor printed with the same resistor paste on a group of substrates has a Gaussian-like distribution. To make all the resistors have the same design value for proper circuit performance, a laser is used to trim resistances up by removing (vaporizing) a small portion of the resistor material. The stability of the trimmed resistor is then a measure of the fractional change (drift) in resistance that occurs after laser trimming. Low resistance drift (high stability) is necessary so that the resistance remains close to its design value for proper circuit performance.

D. Wettability

Wettability of the low softening point glass with respect to the other solids is determined by measuring the contact angle of a molten drop of the low softening point glass on a surface of the other solids. The equilibrium shape assumed by a liquid drop placed on a smooth solid surface under the force of gravity is determined by the mechanical force equilibrium of three surface tensions: δ (LV) at the liquid-vapor interface; δ (SV) at the liquid-solid interface; and δ (SV) at the solid-vapor interface. The contact angle is in theory independent of the drop volume and in the absence of crystallization or interaction between the substrate and the test liquid depends only upon temperature and the nature of the respective solid, liquid and vapor phases in equilibrium. Contact angle measurements are an accurate method for chracterizing the wettability of a solid surface since the tendency for the liquid to spread and "wet" the solids surface increases as the contact angle decreases.

E. Electrostatic Discharge Test

This Electrostatic Discharge (ESD) test is a military standard designated MIL-STD-883C, Method 3015.6. It establishes the means of classifying microcircuits (and resistors on microcircuits) according to their susceptibility to damage or degradation by exposure to electrostatic discharge.

The electrostatic discharge, defined as the transfer of electrostatic charge between two bodies at different electrostatic potentials, used in this test has a rise time between 5 and 10 nanoseconds and a decay time of 150±20 nanoseconds. The test results include the peak voltage and the relative resistance change when the resistor is exposed to the electrostatic discharge.

EXAMPLES

Example 1

An admixture was formed by mixing 25.7 grams of $RuO_2$ powder mixed with 4.8 grams of silver and 2.3 grams of palladium powders. This conductive powder was further mixed with 32.2 grams of a manganese alumino lead borosilicate glass with a softening point of 510° C., 7.7 grams of an alumino lead borosilicate glass with a softening point of 525° C., 0.7 gram of a bismuth silicate glass with a softening point of 445° C. and 23.1 grams of a calcium alumino lead borosilicate with a softening point of 660° C. All the powders were ground to surface areas in the range of 1 to 10 $m^2$/gram.

This powder mixture was dispersed with 38 grams of a liquid medium composed of ethyl cellulose and beta-terpineol to form a viscous suspension with a viscosity between 100 and 300 Pascal-seconds. In practice of the present invention, the dispersion is usually screen printed onto an insulating substrate and fired in air at a temperature of between 700° and 950° C. to produce a fired resistor film.

This resistor, having a printed thickness of 25 microns was fired at 850° C. for 10 minutes. The fired resistor had a resistance of 9.8 ohm per square, and a temperature coefficient of resistance (TCR), measured between 25° and 125° C., was 35 ppm/°C. Its resistance drift after laser trimming and storage in an 85° C./85% relative humidity environment was 0.08±0.06%. Its resistance changed 0.01±0.01% when exposed to a single 5000 V pulse in an electrostatic discharge test and had a maximum rated power of 864 mw/sq.mm.

Example 2

A further admixture was formed by mixing 20.8 grams of $RuO_2$ with 15.0 grams of silver and 7.2 grams of Pd. These conductives were mixed with 26.1 grams of the manganese alumino borosilicate glass, 18.1 grams of the lead alumino borosilicate glass, 10.5 grams of the 600° C. softening point glass, and 2.3 grams of the bismuth silicate glass. After these powders were dispersed in an organic medium to form a paste which was printed in a resistor pattern and fired as in the previous example. The resistance of the resistor was 3.0 ohms per square, and the TCR was 50 ppm/°C. Its resistance drift after laser trimming and storage in an 85° C./85% relative humidity environment was 0.01±0.06%. Its resistance changed −0.01±0.04% when exposed to a single 5000 V pulse in an electrostatic discharge test at a maximum rated power of 888 mw/sq.mm.

Example 3

An admixture of finely divided solids was formed by mixing 19.5 g of silver and 16.4 g of $RuO_2$. These conductives were mixed with 19.5 g of the above-referred alumino lead borosilicate glass and 2.3 g of titania lead aluminoborosilicate glass and 6.3 g of bismuth lead aluminoborosilicate glass. The powders were ground to a surface area of 1–10 $m^2$/g as in Example 1. The ground particles were then dispersed in an organic medium to form a paste. After printing and firing, the resistance of the fired layer was 32.5 ohms/square, HTCR was −47 ppm/°C., and CTCR was −99 ppm/°C.

Example 4

An admixture was formed by mixing 18.4 grams of $RuO_2$ with 11.0 grams of palladium and 19.7 grams of silver. The $RuO_2$ particles were not sintered onto the surfaces of glass particles in this case. This mixture was further mixed with 12.3 grams of the manganese lead alumino borosilicate glass with a softening point of 510° C., 1.9 grams of the bismuth silicate glass with a softening point of 445° C., 4.12 grams of a lead alumino borosilicate glass with a softening point of 600° C., and 8.9 grams of a titania lead alumino borosilicate glass with a softening point of 525° C. Again all the glass surface areas were in the range of 1 to 10 $m^2$/gram.

This powder mixture was also dispersed in the ethyl celulose and beta-terpineol liquid medium to form a viscous suspension with the same viscosity range as in the previous examples. After printing onto an insulating substrate and firing at 850° C. for 10 minutes, the resistance of the printed layer was 2.8 ohms and the temperature coefficient of resistance was 110 ppm/°C. Resistance drift after laser trimming and storage in at 85° C./85% relative humidity for 500 hours was 0.21%.

EXAMPLE 5

An admixture was formed by mixing 11.1 grams of silver/palladium alloy powder with 1.3 grams of palladium and 6.1 grams of $RuO_2$. The alloy had a silver-to-palladium ratio of 2.6. The $RuO_2$ was sintered to the surfaces of a manganese alumino lead borosilicate glass. The amount of this glass, with a softening point of 510° C., was 18.7 grams. This mixture was further mixed with 0.7 grams of the calcium alumino lead borosilicate glass with a softening point of 660° C., 1.7 grams of the alumino lead borosilicate glass with a softening point of 600° C., and 4.73 grams of a titania alumino lead borosilicate glass with a softening point of 525° C. This powder mixture was dispersed in 23 grams of an organic medium containing ethyl cellulose and beta-terpineol. The resistor, after printing onto an insulating substrate and firing at 850° C. for 10 minutes, had a resistance of 8.3 ohms/square, and a temperature coefficient of resistance between −55° and 25° C. of 88 ppm/°C. Its resistance drift after laser trimming and storage in an 85° C./85% relative humidity was 0.12%.

Next is an example of a resistor with a relatively high level of Pd. The Ag/(Pd+Ag) ratio is only 42%, compared with approximately 60% for most of the other examples.

EXAMPLE 6

An admixture was formed by mixing 14.6 grams of $RuO_2$ with 16.85 grams of palladium and 12.2 grams of silver. The Ag/(Pd+Ag) ratio in this case was only 42%, compared with approximately 60% for most of the other examples. This mixture is further mixed with 7.8 grams of manganese alumino lead borosilicate glass with a softening point of 510° C. and 24.4 grams of the titania alumina lead borosilicate glass with a softening point of 525° C.

This powder mixture was dispersed with 27.2 grams of the ethyl cellulose, beta-terpineol liquid. The fired resistor had a resistivity of 85 ohms and a temperature coefficient of resistance between −55° and 25° C. of −257 ppm/°C. This negative coefficient is correctable to more positive values by balancing the relative amounts of the different glasses.

I claim:

1. A thick film composition for the preparation of fired resistors having a resistance of less than 100 ohms per square comprising an admixture of finely divided particles of:

(a) silver, palladium, an alloy of palladium and silver or mixtures thereof, in which the weight ratio of palladium to silver is from 32:68 to 58:42;

(b) 40–80% by volume, basis total particulate solids in the composition, of an admixture of (1) 0.2 to 5.0% by weight, basis total solids, of a non-crystallizing glass having a softening point of 350° to 500° C., which when molten is wetting with respect to the other solids in the composition, and (2) a glass having softening point of 550° to 650° C.; and (c) 5–20% by volume, basis total particulate solids in the composition of uncoated sub-micron particles of $RuO_2$, all of (a) through (c) being dispersed in (d) an organic medium.

2. The composition of claim 1 in which component (a) is an alloy of palladium and silver.

3. The composition of claim 1 in which component (a) is a mixture of palladium and silver particles.

4. The composition of claim 3 in which the palladium and silver are in the form of an alloy containing 40% silver and 60% palladium.

5. The composition of claim 1 in which the $RuO_2$ particles are sintered to the surface of particles of an intermediate glass having a softening point of 400°–650° C.

6. The composition of claim 3 in which the intermediate glass contains 1–15% by weight of transition metal oxide.

7. The composition of claim 1 in which the softening point of the lower melting glass is 375°–425° C.

8. The composition of claim 1 in which the softening point of the higher melting glass is 575°–600° C.

9. The composition of claim 1 in which the average particle size of the glass is 2–3 microns and substantially all of the glass particles are from 0.1 to 10 microns in size.

* * * * *